US005860338A

United States Patent [19]

Littlefield

[11] Patent Number: 5,860,338

[45] Date of Patent: Jan. 19, 1999

[54] DUAL DRIVE ADAPTER

[76] Inventor: Kirk A. Littlefield, P.O. Box 1074, Old Town Rd., Block Island, R.I. 02807

[21] Appl. No.: 835,219

[22] Filed: Apr. 7, 1997

[51] Int. Cl.[6] ..... B25B 23/16

[52] U.S. Cl. ..... 81/177.2; 81/177.85

[58] Field of Search ..... 81/177.2, 177.85, 81/DIG. 11, 180.1, 185

[56] References Cited

U.S. PATENT DOCUMENTS

| | | | |
|---|---|---|---|
| 2,963,930 | 12/1960 | Clothier et al. | 81/177.2 |
| 3,227,015 | 1/1966 | Tremblay | 81/177.2 |
| 4,367,663 | 1/1983 | Merics | 81/177.2 |
| 5,168,782 | 12/1992 | Cromwell | 81/177.85 |
| 5,485,769 | 1/1996 | Olson et al. | 81/177.85 |
| 5,509,333 | 4/1996 | Rion | 81/180.1 |
| 5,752,418 | 5/1998 | Robins | 81/177.2 |

*Primary Examiner*—David A. Scherbel
*Assistant Examiner*—Joni B. Danganan
*Attorney, Agent, or Firm*—Fulbright & Jaworski, LLP.

[57] ABSTRACT

A drive adapter for use with a first wrench including a first type drive lug of a first size and for use with a second wrench including a second type drive lug of a second size. The drive adapter comprises a main body including a first end, a second end and an axial hole therethrough. The first end includes a hole of a first size adapted to receive the first wrench first type drive lug while the second end includes a hole of a second size adapted to receive the second wrench second type drive lug. The drive adapter further comprises a rod including a first type drive lug of a first size and a second type drive lug of a second size where the rod first type drive lug is adapted to slideably engage the main body first end hole and the rod second type drive lug is adapted to slideably engage the main body second end hole so that the rod is repositionable along the main axial body hole. In a first mode of operation, the rod is selectively moveable to a first operative position wherein the rod first type drive lug extends outward from the main body and the rod second type drive lug is recessed inside the main body so that the second wrench may be operatively connected to the main body second end hole. Similarly, in a second mode of operation, the rod is selectively moveable to a second operative position wherein the rod second type drive lug extends outward from the main body and the rod first type drive lug is recessed inside the main body so that the first wrench may be operatively connected to the main body first end hole.

8 Claims, 3 Drawing Sheets

DUAL DRIVE ADAPTER

FIELD OF THE INVENTION

The invention relates generally to drive adapters for converting a wrench or other hand tool having a drive lug from one size to another size. More particularly, the invention relates to a drive adapter operable in a first mode for converting a wrench having a first size drive lug to a second size drive lug and operable in a second mode for converting a wrench having a second size drive lug to a first size drive lug.

BACKGROUND OF THE INVENTION

Socket sets are well known. Generally, socket sets come in a variety of different styles which are suited for different uses. A typical socket has one end for detachably mounting to a wrench or other hand tool (hereinafter collectively referred to as "wrench") and another end for operative engagement with a nut, bolt, bit or the like, such as: hex head nuts and bolts, star head nuts and bolts, other polygonal head nuts and bolts, Allen head bolt, Phillips screws and slotted screws (hereinafter collectively referred to as "nut" or "nuts"). Additionally, each socket in a socket set comes with a different size operative end for engagement with different size nuts. In contrast, the mounting end of each socket is generally of the same size for detachably mounting to a wrench having a drive lug of a particular size.

However, the size of the mounting end of each socket is generally dependent upon the size of the operative end. For example, a hex head socket set having operative ends ranging from ⅛ inch to 1.0 inch may include mounting ends of three different sizes. Additionally, the mounting ends (sometimes referred to as the female end) for each socket in a socket set accept the same type of drive lug (sometimes referred to as the male end), such as a square drive. Generally, it is common for a ⅛ inch hex head socket to have a mounting end which requires a ¼ inch square drive lug, a ½ inch hex head socket to have a mounting end which requires a ⅜ inch square drive lug and a 1 inch hex head socket to have a mounting end which requires a ½ inch square drive lug. Still larger range sockets may require even larger size drive lugs.

Therefore, there is a need to provide a variety of different size drive lugs to accommodate the different size mounting ends of the various sockets. In many instances, this is accomplished by utilizing a plurality of different wrenches with the socket set. Thus, in the example above, a first wrench having a ¼ inch drive lug, a second wrench having ⅜ inch drive lug and a third wrench having ½ inch drive lug wrench be required. Although this approach generally works well, it requires the purchase of a plurality of wrenches which adds to the overall cost of the tools and increases the amount of storage space needed. Additionally, there are instances when it is desirable to use the ¼ inch drive lug wrench to drive a socket having a mounting end which requires a ½ inch drive lug. This situation typically arises when working in close quarters where the surrounding space is not adequate to provide enough working room to maneuver the ½ inch drive lug wrench which is often considerably larger than the ¼ inch drive lug wrench. On the other hand, there are instances when it is desirable to use the ½ inch drive lug wrench to drive a socket having a mounting end which requires a ¼ inch drive lug. This situation typically arises when the extra leverage of the larger ½ inch drive lug wrench is required to apply greater amounts of torque to the nut.

Prior art adapters have been developed which have attempted to solve these problems. Generally, the prior art adapters include one end having a drive lug of a first size and another end having a socket for accepting a drive lug of a second size. In this manner, the socket end of the prior art adapter can be operatively connected to a wrench having a drive lug of the second size. Thus, the wrench is effectively converted to having a drive lug of the first size.

Although such prior art adapters generally work well, they suffer from certain drawbacks and disadvantages. Such prior art adapters are typically of unitary construction such that the drive end and the socket end are fashioned out of a single piece of material. Accordingly, the prior art adapters are only capable of converting a wrench having a first size drive lug to a second size drive lug. Thus, a separate adapter is necessary for each drive lug conversion. This requires a large number of adapters to accommodate the various drive lug conversions (½ inch to ⅜ inch, ½ inch to ¼ inch, ⅜ inch to ¼ inch, ⅜ inch to ½ inch, etc.) which adds to the overall cost of the tools and increases the amount of storage space needed.

Based on the above discussion, it becomes apparent that there is a need for a drive adapter capable of performing multiple conversions. In this manner, the number of drive adapters necessary and overall tool costs would be reduced.

SUMMARY OF THE INVENTION

It is an object of the present invention to present a drive adapter that substantially overcomes the disadvantages and drawbacks associated with the prior art drive adapters.

In accomplishing this and other objects, there is provided a drive adapter for use with a first wrench including a first type drive lug of a first size and for use with a second wrench including a second type drive lug of a second size. The drive adapter comprises a main body including a first end, a second end and an axial hole therethrough. The first end includes a hole of a first size adapted to receive the first wrench first type drive lug while the second end includes a hole of a second size adapted to receive the second wrench second type drive lug. The drive adapter further comprises a rod including a first type drive lug of a first size and a second type drive lug of a second size where the rod first type drive lug is adapted to slideably engage the main body first end hole and the rod second type drive lug is adapted to slideably engage the main body second end hole so that the rod is repositionable along the main axial body hole. In a first mode of operation, the rod is selectively moveable to a first operative position wherein the rod first type drive lug extends outward from the main body and the rod second type drive lug is recessed inside the main body so that the second wrench may be operatively connected to the main body second end hole. Similarly, in a second mode of operation, the rod is selectively moveable to a second operative position wherein the rod second type drive lug extends outward from the main body and the rod first type drive lug is recessed inside the main body so that the first wrench may be operatively connected to the main body first end hole.

Additional objects and advantages of the invention will be set forth in the detailed description which follows and, in part, will be obvious to those skilled in the art from the detailed description, or may be learned by practice of the invention.

BRIEF DESCRIPTION OF THE DRAWINGS

The accompanying drawings, which are incorporated in and constitute a part of the specification, illustrate a presently preferred embodiment of the present invention. The drawings, together with the general description given above and the detailed description of the preferred embodiments given below, serve to explain the principles of the invention.

DESCRIPTION OF THE PREFERRED EMBODIMENTS

Figure 1:
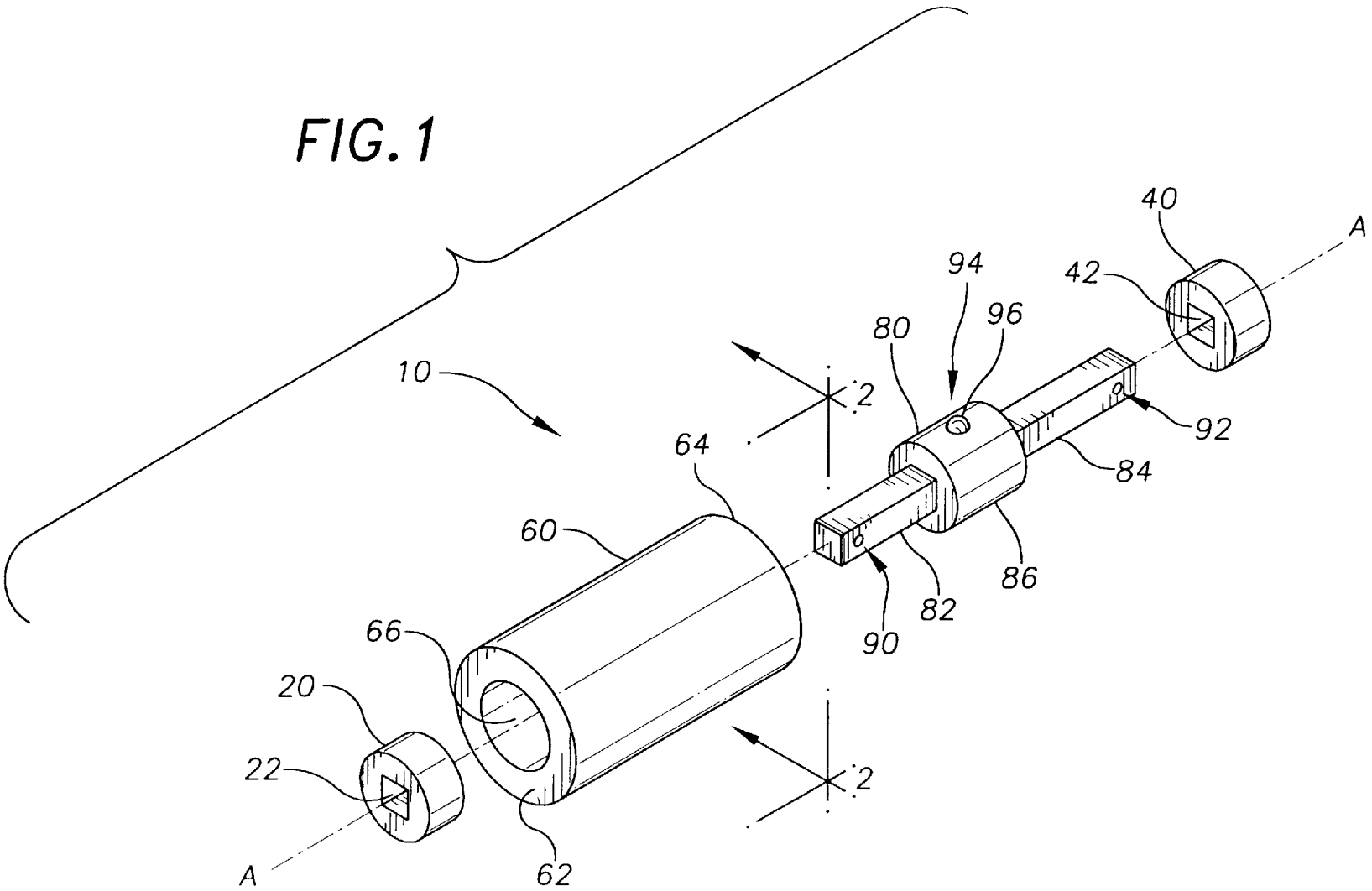
FIG. 1 is an exploded perspective view of a drive adapter in accordance with the present invention.

Referring to FIG. 1, an exploded perspective view of a drive adapter 10 in accordance with the present invention is shown. The drive adapter 10 includes a first plug 20, a second plug 40, a main body 60 and a rod 80. The main body 60 is of generally cylindrical shape and includes a first end 62, a second end 64 and a generally cylindrical shaped axial hole 66 running therethrough from the first end 62 to the second end 64. The body 60 and the hole 66 are aligned along a centerline defined by lines A—A.

The first and second plugs 20 and 40, respectively, are generally cylindrical shaped and have respective outside diameters which are sized to provide an appropriate press fit when assembled into the hole 66 of the body 60. The first plug 20 is pressed into the first end 62 of the body 60 while the second plug 40 is pressed into the second end 64 of the body 60. The first plug 20 and the second plug 40 include generally square shaped axial holes 22 and 42, respectively.

The rod 80 includes a first drive lug 82, a second drive lug 84 and a shank 86 extending between the first drive lug 82 and the second drive lug 84. The shank 86 is generally cylindrical shaped and has an outside diameter which is sized to provide an appropriate slip fit when assembled into the hole 66 of the body 60. The first plug 20, the second plug 40 and the rod 80 are assembled to the main body 60 so that the rod 80 is captured therebetween. The first drive lug 82 is generally square shaped and is ⅜ inch in size. The hole 22 of the first plug 20 is sized to provide an appropriate slip fit when assembled to the first drive lug 82 of the rod 80. Similarly, the second drive lug 84 is generally square shaped and is ½ inch in size. The hole 42 of the second plug 40 is sized to provide an appropriate slip fit when assembled to the second drive lug 84 of the rod 80. In this manner, the first drive lug 82 of the rod 80 is slideably engaged with the hole 22 of the first plug 22 and the second drive lug 84 of the rod 80 is slideably engaged with the hole 42 of the second plug 42 so that the rod 80 is axially movable with respect to the body 60, the first plug 20 and the second plug 40. However, because the shank 86 is larger in diameter than the first plug 20 and the second plug 40, the rod 80 is captured therebetween and cannot be separated from the body 80 of the drive adapter 10. Thus, the various components of the drive adapter 10 remain together and cannot be lost.

The rod 80 further includes a ball detent assembly 90 on the first drive lug 82, a ball detent assembly 92 on the second drive lug 84 and a ball detent assembly 94 on the shank 86. The ball detent assembly 94 includes a ball 96 and other components which are not shown. The ball detent assemblies 90, 92 and 94, respectively, are of uniform design. Since ball detent assemblies are well known in the art, their description will be limited to that which is necessary for an understanding of the present invention.

Figure 2:
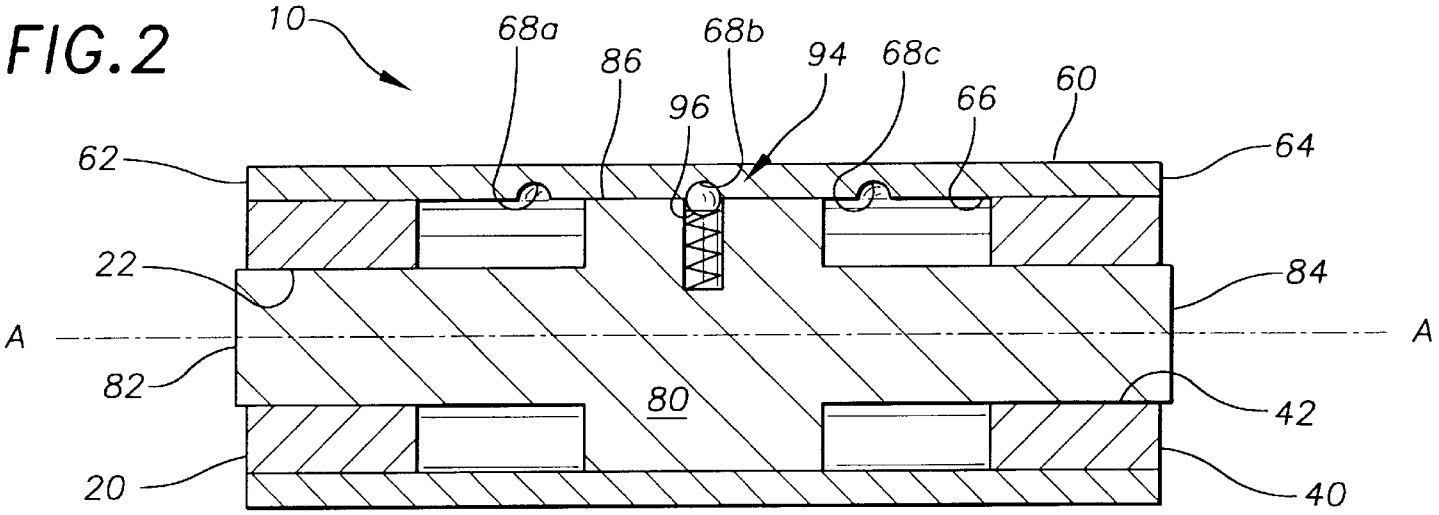
FIG. 2 is a cross sectional assembly view taken along lines 2—2 as shown in FIG. 1 of the drive adapter including an axially movable rod in a home position in accordance with the present invention.

Referring to FIG. 2, a cross sectional assembly view of the drive adapter 10 is shown. Furthermore, the rod 80 is shown in a home position. The body 60 further includes a plurality of ball seats 68*a*, 68*b* and 68*c*, respectively, spaced axially along the hole 66 between the first end 62 and the second end 64. The plurality of ball seats 68*a*, 68*b* and 68*c*, respectively, are adapted to selectively receive the ball 96 of the ball detent assembly 94. In this manner, the rod 80 is repositionable along the axis of the body 60 with ball 96 dropping into the plurality of ball seats 68*a*, 68*b* and 68*c*, respectively, for holding the rod 80 in these predetermined positions. The ball seat 68*a* corresponds to a first operative position, the ball seat 68*b* corresponds to the home position and the ball seat 68*c* corresponds to a second operative position for the rod 80. Those skilled in the art will recognize that the plurality of ball seats 68*a*, 68*b* and 68*c* and the ball detent assembly 94 are optional and not required elements of the present invention.

Because the first plug 20 and the second plug 40 contain square shaped holes, 22 and 42, respectively, the rod 80 is prevented from spinning inside the hole 66. Thus, the rod 80 is restricted to axial movement along lines A—A. To assist in the alignment of the first plug 20, the second plug 40 and the rod 80 to the body 60, these components may be optionally keyed together using conventional techniques so that the components automatically come into alignment during assembly. Keying the components together provides for a mechanical interlock which eliminates the need for the press fits to withstand the torsional loading present during use of the drive adapter 10.

Figure 3:
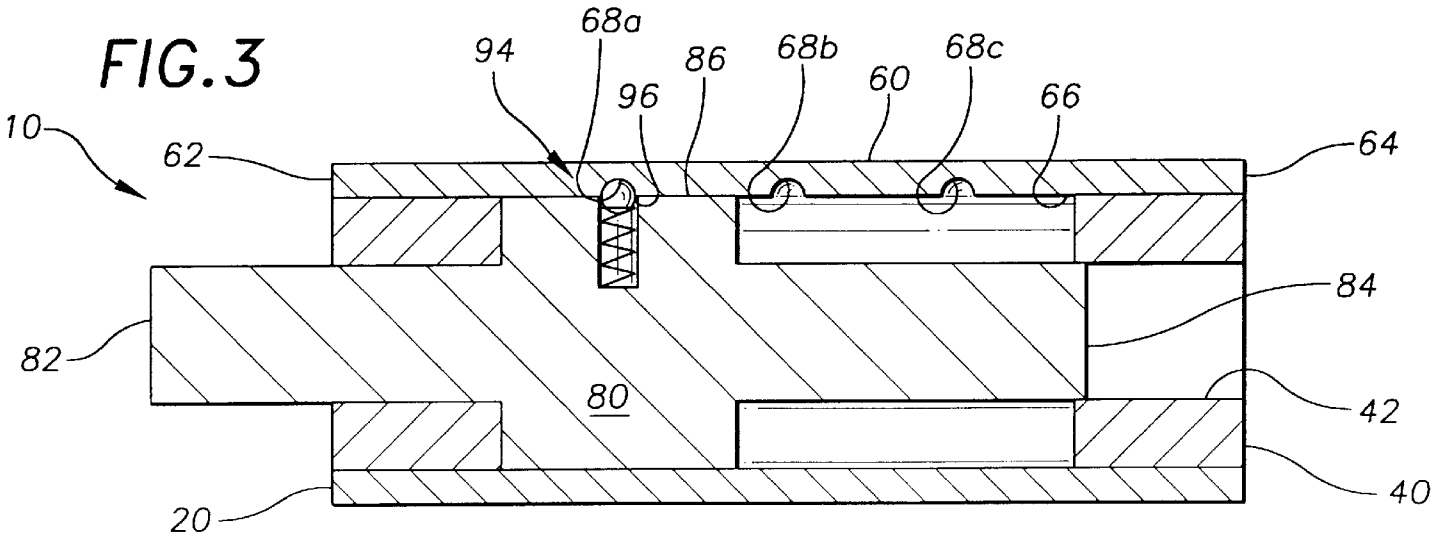
FIG. 3 is a cross sectional assembly view taken along lines 2—2 as shown in FIG. 1 of the drive adapter including the axially movable rod in a first operative position in accordance with the present invention.
Figure 4:
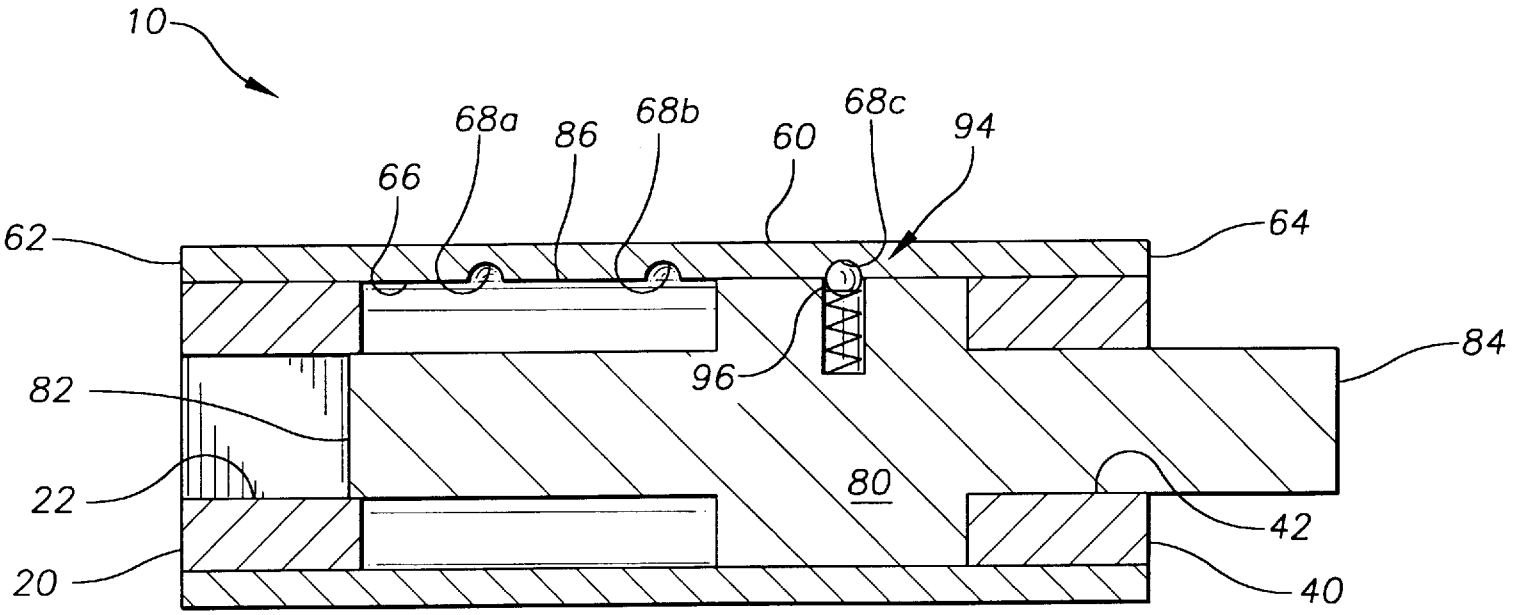
FIG. 4 is a cross sectional assembly view, taken along lines 2—2 as shown in FIG. 1, of the drive adapter including the axially movable rod in a second operative position in accordance with the present invention.

With the structure of the drive adapter 10 described as above, the operational characteristics will now be described. Referring to FIGS. 2, 3 and 4, the drive adapter 10 is shown with the rod 80 in the home position, the first operative position and the second operative position, respectively. Generally, the rod 80 is placed in the home position for storage. In this position, the first drive lug 82 and the second drive lug 84 extend slightly outward from the first plug 20 and the second plug 40, respectively. This prevents contaminants from entering into the holes 22 and 42, respectively. Furthermore, the drive adapter 10 occupies the least amount of space when the rod 80 is in the home position. In other words, the maximum amount of the rod 80 is located within the body 60 or the minimum amount of the rod 80 extends outside the body 60.

Referring to FIG. 3, the rod 80 is shown in the first operative position. In this position, the rod 80 tends to remain in a fixed axial position with respect to the body 60 due to the ball 96 resting in the ball seat 68*a*. In the first operative position, the first drive lug 82 extends predominately outward from the first plug 20 and the second drive lug 84 is recessed within the body 60 of the drive adapter 10. In this manner, the drive adapter 10 can be operatively connected to a wrench (not shown) having a ½ inch drive lug (not shown) by slipping the second plug 40 onto the ½ inch drive lug. Since the first drive lug 82 is ⅜ inch in size and extends outward from the body 60, the wrench is effectively converted to a ⅜ inch drive. Thus, a socket (not shown) having a mounting end which requires a ⅜ inch drive can be operatively connected to the wrench having a ½ inch drive lug using the drive adapter 10 with the rod 80 in the first operative position. Since wrenches are well known in the art and do not constitute a part of the present invention, their description will be limited to that which is necessary for an understanding of the present invention.

Referring to FIG. 4, the rod 80 is shown in the second operative position. In this position, the rod 80 tends to remain in a fixed axial position with respect to the body 60 due to the ball 96 resting in the ball seat 68*c*. In the second operative position, the second drive lug 84 extends predominately outward from the second plug 40 and the first drive lug 82 is recessed within the body 60 of the drive adapter 10. In this manner, the drive adapter 10 can be operatively connected to a wrench (not shown) having a ⅜ inch drive lug (not shown) by slipping the first plug 20 onto the ⅜ inch drive lug. Since the second drive lug 84 is ½ inch in size and extends outward from the body 60, the wrench is effectively converted to a ½ inch drive. Thus, a socket (not shown) having a mounting end which requires a ½ inch drive can be operatively connected to the wrench having a ⅜ inch drive lug using the drive adapter 10 with the rod 80 in the second operative position.

Referring to FIGS. 3 and 4, to add to the stability of the rod 80, when the rod 80 is in the first operative position, the second drive lug 84 remains in contact with the second plug 40. Similarly, when the rod 80 is in the second operative position, the first drive lug 82 remains in contact with the first plug 20. Additionally, the rod 80 is prevented from randomly sliding along the axis of the hole 66 by the ball detent assembly 94 and the ball seats 68*a*, 68*b* and 68*c*, respectively. Thus, the rod 80 has three steady positions (first operative, second operative and home) along the axis of the hole 66 which assist a user in assembling the drive adapter 10 to the wrench and assembling the socket to the drive adapter 10.

It should now be apparent that the drive adapter 10 of the present invention substantially overcomes the disadvantages and drawbacks associated with the prior art drive adapters by providing for dual (two) conversions in one drive adapter. In this manner, the number of drive adapters necessary to provide the various combinations of conversions that are necessary is greatly reduced.

Those skilled in the art will recognize that by changing the size of the holes 22 and 42 in the plugs 20 and 40, respectively, along with corresponding changes to the size of the drive lugs 82 and 84, respectively, that any desired conversions can be achieved. For example, if the second drive lug 84 and the hole 42 in the second plug 40 were designed to be ¼ inch in size, then the drive adapter 10 would be capable of converting a wrench (not shown) having a ¼ inch drive to a ⅜ inch drive and converting a wrench (not shown) having a ⅜ inch drive to a ¼ inch drive. Furthermore, the present invention has been described with respect to square drive lugs which are sized according to inch based units as are prevalent in the United States. However, it should be apparent that the present invention is equally well suited for square drive lugs of metric based units as are prevalent in other countries.

Many features of the preferred embodiment represent design choices selected to best exploit the inventive concepts as implemented in a drive adapter for converting a square drive lug of a first size to a square drive lug of a second size. However, various modifications will readily occur to those skilled in the art. For example, the inventive aspects of the present invention are not limited to converting square drive lugs. On the contrary, the present invention is equally applicable to converting drive lugs of different shapes (triangles, stars, polygons, etc.) from a first size to a second size and vice versa. It is even within the contemplation of this invention to design the first drive lug 82 to be of a first type, for example square drive, and the second drive lug 84 to be of a second type, for example triangle drive.

As another example, the ball detent assembly 94 and the ball seats 68*a*, 68*b* and 68*c* can be arranged in a variety of configurations. For instance, the ball detent assembly 94 and the ball seat 68*b* can be eliminated while the ball seat 68*a* is relocated to the first plug 20 and the ball seat 68*c* is relocated to the second plug 40. In this arrangement, the ball seat 68*a* is positioned to accept the ball detent assembly 90 when the rod 80 is in the second operative position. In similar fashion, the ball seat 68*c* is positioned to accept the ball detent assembly 92 when the rod 80 is in the first operative position. In this manner, the rod 80 has two stable positions.

Those skilled in the art will likely find still further modifications and substitutions without departing from the inventive concepts disclosed. Therefore, the inventive concept in its broader aspects is not limited to the specific details of the preferred embodiments but is defined by the appended claims and their equivalents.

What is claimed is:

1. A drive adapter for use with a first wrench having a drive lug of a first size and first polygonal cross-section and for use with a second wrench having a drive lug of a second size and second polygonal cross-section, wherein the sizes of the first wrench drive lug and second wrench drive lug are different, the drive adapter comprising;

a main body including a first end, a second end and an axial hole therethrough, the first end including a hole of a first size adapted to receive the first wrench drive lug, the second end including a hole of a second size adapted to receive the second wrench drive lug; and a rod including a first drive lug of a first size and first polygonal cross-section, a second drive lug of a second size and second polygonal cross-section, wherein the sizes of the rod's first drive lug and rod's second drive lug are different, the rod's first drive lug adapted slidably engage the main body first end hole and the rod's second drive lug adapted to slidably engage the main body second end hole so that the rod is repositionable along the main axial body hole; and wherein:

the rod is selectively moveable to a first operative position wherein the rod's first drive lug extends outward from the main body and the rod's second drive lug is recessed inside the main body so that the second wrench may be operatively connected to the main body second end hole; and the rod is selectively movable to a second operative position wherein the rod's second drive lug extends outward from the main body and the rod's first drive lug is recesses inside the main body so that the first wrench may be operatively connected to the main body first end hole; and the rod further includes a shank portion extending between the rod's first drive lug and the rod's second drive lug and being slidably engaged in the main body axial hole, said shank portion being larger in size than the rod, the main body first end hole, and the main body second end hole, so that the shank portion is captured therebetween preventing the rod from becoming separated form the main body.

2. The drive adapter of claim 1, wherein the rod's first drive lug and rod's second drive lug are each of a square polygonal cross-section.

3. The drive adapter of claim 1, wherein the rod's first drive lug and rod's second drive lug are each of a square polygonal cross-section.

4. The drive adapter of claim 3, wherein the size of the rod's first drive lug is ⅜ inch and the size of the rod's second drive lug is ½ inch.

5. A drive adapter for use with a first wrench having a drive lug of a first size and first polygonal cross-section and for use with a second wrench having a drive lug of a second size and second polygonal cross-section, wherein the sizes of the first wrench drive lug and second wrench drive lug are different, the drive adapter comprising:

a main body including a first end, a second end and an axial hole therethrough, the first end including a hole of a first size adapted to receive the first wrench drive lug, the second end including a hole of a second size adapted to receive the second wrench drive lug; and a rod including a first drive lug of a first size and first polygonal cross-section, a second drive lug of a second size and second polygonal cross-section, wherein the sizes of the rod's first drive lug and rod's second drive lug are different, the rod's first drive lug adapted slidably engage the main body first end hole and the rod's second drive lug adapted to slidably engage the main body second end hole so that the rod is repositionable along the main axial body hole; and wherein:

the rod is selectively moveable to a first operative position wherein the rod's first drive lug extends outward from the main body and the rod's second drive lug is recessed inside the main body so that the second wrench may be operatively connected to the main body second end hole;

the rod further includes a shank portion extending between the rod's first drive lug and the rod's second drive lug and being slidably engaged in the main body axial hole, said shank portion being larger in size than the rod, the main body first end hole, and the main body second end hole, so that the shank portion is captured therebetween preventing the rod from becoming separated form the main body; and the rod is selectively movable to a second operative position wherein the rod's second drive lug extends outward from the main body and the rod's first drive lug is recesses inside the main body so that the first wrench may be operatively connected to the main body first end hole;

wherein the main body further includes a first seat, a second seat, and a third seat, each spaced axially along the main body axial hole such that the third seat is portioned between the first seat and second seat, and the rod further includes detent means for selectively engaging the first seat when the rod is in the first operative position to hold the rod in the first operative position, the second seat when the rod is in the second operative position to hold the rod in the second operative position, and third seat to move the rod to a home position, so that a maximum amount of the rod is recessed inside the main body.

6. The drive adapter of claim 5, wherein the rod's first drive lug and rod's second drive lug are of the same polygonal cross-section.

7. The drive adapter of claim 5, wherein the rod's first drive lug and rod's second drive lug are each of a square polygonal cross-section.

8. The drive adapter of claim 7, wherein the size of the rod's first drive lug is ⅜ inch and the size of the rod's second drive lug is ½ inch.

* * * * *